US010623865B2

(12) United States Patent
Reining

(10) Patent No.: US 10,623,865 B2
(45) Date of Patent: Apr. 14, 2020

(54) SYSTEM AND METHOD FOR APPLYING A SOUND SIGNAL TO A MULTI COIL ELECTRODYNAMIC ACOUSTIC TRANSDUCER

(71) Applicant: Sound Solutions International Co., Ltd., Beijing (CN)

(72) Inventor: Friedrich Reining, Vienna (AT)

(73) Assignees: AAC TECHNOLOGIES PTE. LTD., Singapore (SG); AAC TECHNOLOGIES (NANJING) CO., LTD., Nanjing (CN)

( * ) Notice: Subject to any disclaimer, the term of this patent is extended or adjusted under 35 U.S.C. 154(b) by 52 days.

(21) Appl. No.: 15/936,937

(22) Filed: Mar. 27, 2018

(65) Prior Publication Data

US 2018/0279052 A1 Sep. 27, 2018

(30) Foreign Application Priority Data

Mar. 27, 2017 (AT) ..... A 50242/2017

(51) Int. Cl.

| | |
|---|---|
| ***H04R 9/06*** | (2006.01) |
| ***H04R 9/02*** | (2006.01) |
| ***H04R 9/04*** | (2006.01) |
| *H04R 3/00* | (2006.01) |

(52) U.S. Cl.

CPC ..... *H04R 9/063* (2013.01); *H04R 9/025* (2013.01); *H04R 9/045* (2013.01); *H04R 9/046* (2013.01); *H04R 3/00* (2013.01); *H04R 2209/024* (2013.01); *H04R 2209/041* (2013.01)

(58) Field of Classification Search

CPC . H04R 3/04; H04R 9/025; H04R 3/08; H04R 29/00

USPC .... 381/108, 102, 59, 96, 117, 162, 396, 401

See application file for complete search history.

(56) References Cited

U.S. PATENT DOCUMENTS

| | | | | |
|---|---|---|---|---|
| 5,009,108 | A | 4/1991 | Harada et al. | |
| 5,828,767 | A | 10/1998 | Button | |
| 9,300,192 | B2 * | 3/2016 | Weinl | H02K 11/25 |
| 10,034,109 | B2 * | 7/2018 | Russell | H04R 9/063 |
| 2005/0031139 | A1 * | 2/2005 | Browning | H04R 3/002 381/96 |

(Continued)

FOREIGN PATENT DOCUMENTS

| | | | |
|---|---|---|---|
| CN | 101415143 | A | 4/2009 |
| EP | 2400784 | A1 | 12/2011 |
| WO | 2005015955 | A2 | 2/2005 |

OTHER PUBLICATIONS

Office Action, Pat. Appl. DE 10 2018 002 290.1, dated Dec. 12, 2018 (German Patent and Trade Mark Office).

*Primary Examiner* — Alexander Krzystan

(57) ABSTRACT

A transducer system, comprising an electrodynamic acoustic transducer (1) with a membrane (3), a plurality of voice coils (7, 8) electrically switched in series, and a magnet system (9, 10, 11) is presented, wherein just an outer tap/terminal (T2) of the serially connected voice coils (7, 8) is electrically connected to an audio output of an amplifier (17). Moreover, a method for feeding a sound signal to an electrodynamic acoustic transducer (1) is presented, wherein the voice coils (7, 8) are driven by an audio signal just via an outer tap/terminal (T2) of the serially connected voice coils (7, 8).

32 Claims, 3 Drawing Sheets

(56) References Cited

U.S. PATENT DOCUMENTS

| | | | | |
|---|---|---|---|---|
| 2006/0104451 | A1* | 5/2006 | Browning | H04R 29/003 381/59 |
| 2008/0025551 | A1 | 1/2008 | Wehner | |
| 2014/0321690 | A1 | 10/2014 | Reining | |
| 2016/0192079 | A1 | 6/2016 | Reining | |
| 2018/0160227 | A1* | 6/2018 | Lawrence | H04R 3/007 |

* cited by examiner

SYSTEM AND METHOD FOR APPLYING A SOUND SIGNAL TO A MULTI COIL ELECTRODYNAMIC ACOUSTIC TRANSDUCER

CROSS-REFERENCE TO RELATED APPLICATIONS

This application claims priority to Austria Patent Application No. A50242/2017, filed on Mar. 27, 2017, which is hereby incorporated by reference in its entirety.

BACKGROUND OF THE INVENTION

The invention relates to a transducer system, which comprises an electrodynamic acoustic transducer with a membrane, a coil arrangement attached to the membrane and a magnet system being designed to generate a magnetic field transverse to a longitudinal direction of a wound wire of the coil arrangement. The coil arrangement comprises a plurality of voice coils, in particular two voice coils, electrically switched in series. Furthermore, the invention relates to a method for applying a sound signal to an electrodynamic acoustic transducer of the kind above.

A transducer system and a method of the kind above generally are known in prior art. In this context, US 2014/321690 A1 discloses an audio system that comprises an electro-acoustic transducer connected to a first driver circuit and a second driver circuit. The electro-acoustic transducer comprises a first coil stacked on a second coil mechanically linked to a membrane, with the coils oscillating in the magnetic field of a permanent magnet focused by a pole plate. The first coil and the second coil are mechanically arranged symmetrical to the pole plate in a magnetic zero position.

A drawback of the transducer system and the method disclosed in US 2014/0321690 A1 is the need to use two separate amplifiers to supply a sound signal to the electrodynamic acoustic transducer. Accordingly, technical complexity and costs are comparably high, whereas reliability of the transducer system is comparably low.

SUMMARY OF THE INVENTION

Thus, it is an object of the invention to overcome the drawbacks of the prior art and to provide an improved transducer system and a method for supplying a sound signal to an electrodynamic acoustic transducer. Particularly, technical complexity and costs shall be reduced, while at the same time reliability shall be increased.

The inventive problem is solved by a transducer system as defined in the opening paragraph, wherein just an outer tap/terminal of the coil arrangement/serially connected voice coils is electrically connected to an audio output of an amplifier. In other words, the coil arrangement is electrically connected to an audio output of an amplifier just via an outer tap/terminal of the coil arrangement/serially connected voice coils. The amplifier may be part of a driving circuit, which then is also part of the transducer system.

Furthermore, the inventive problem is solved by a method as defined in the opening paragraph, wherein the coil arrangement is driven by an audio signal just via an outer tap/terminal of the coil arrangement/serially connected voice coils.

In other words, a current caused by the sound signal flows into a first outer tap/terminal of the coil arrangement, sequentially through each of the coils and out of a second outer tap/terminal of the coil arrangement.

By the measures presented above, the technical complexity of a transducer system and costs for producing the same are reduced. At the same time reliability is increased. Concretely, wiring of the electrodynamic acoustic transducer is eased. Particularly, the electrical connection to outer taps/terminals of the coil arrangement are the only electrical connection between the amplifier and the coil arrangement.

In particular, the transducer moreover may be driven by an audio signal of a single amplifier. In this case the coil arrangement is electrically connected to the audio output of just a single amplifier. By eliminating the need of a separate amplifier for each voice coil of the coil arrangement, reliability can substantially be increased. For coil arrangements having two voice coils, the risk for a failure of the amplification part of the transducer system is reduced by 50%. If the coil arrangement comprises more than two voice coils, this factor is even increased.

Generally, the proposed transducer system and method relate to electrodynamic acoustic transducers with two voice coils or more. The amplifier may be an unipolar amplifier having one sound output and a connection to ground. In this case one outer tap/terminal of the coil arrangement/serially connected voice coils is electrically connected to the audio output of the amplifier, the other one is connected to ground. However, the amplifier may also be a bipolar one having two dedicated sound outputs. In this case one outer tap/terminal of the coil arrangement/serially connected voice coils is electrically connected to a first audio output of the amplifier, the other one is connected to the other second audio output. Generally, an amplifier may have more amplification stages. In this case, the outputs of the intermediate stages are not considered to have an "audio output" for the concerns of this disclosure. The "audio output" is the output of the very last stage, which finally is connected to the transducer.

Further details and advantages of the audio transducer of the disclosed kind will become apparent in the following description and the accompanying drawings.

Beneficially, a connection point between two voice coils is electrically connected to an input of the amplifier or electronic circuit (particularly to an input of the driving circuit). In this way, the voltage at the connection point may be used for controlling the transducer system. In particular, an offset of the coil arrangement from a magnetic zero position or the magnetic zero position itself may be detected and corrected.

Particularly, the electrical connection to outer taps/terminals of the coil arrangement and the electrical connection to the connection point between two voice coils are the only electrical connections between the amplifier (or electronic circuit) and the coil arrangement in the above case. The connection point between two voice coils moreover may be connected just to an input of a further electronic circuit. In this way, wiring between the amplifier and the electrodynamic transducer is comparably easy in view of the function of the transducer system.

Advantageously, the transducer system comprises an electronic offset compensation module/circuit, which is designed to be connected to the coil arrangement of the electrodynamic acoustic transducer, wherein the coil arrangement comprises two voice coils and wherein the electronic offset compensation module/circuit is designed to apply a control voltage UCTRL to at least one of the voice coils and to alter said control voltage UCTRL until the electromotive force Uemf1 of the first coil or a parameter derived thereof and the electromotive force Uemf2 of the second coil or a parameter derived thereof substantially reach a predetermined relation. Accordingly, a control voltage is applied to at least one of the voice coils and altered until the electromotive force Uemf1 of the first coil or a parameter derived thereof and the electromotive force Uemf2 of the second coil or said parameter derived thereof substantially reach a predetermined relation. In other words, a control voltage is applied to at least one of the voice coils and altered until the instantaneous relation between the electromotive force Uemf1 of the first coil and the electromotive force Uemf2 of the second coil substantially equals a desired relation or until the instantaneous relation between a parameter derived from the electromotive force Uemf1 of the first coil and the parameter derived from the electromotive force Uemf2 of the second coil substantially equals a desired relation.

In real applications, the first and the second coil often do not rest in a magnetic zero position. In other words, the idle position of the membrane (x=0) often does not coincide with the point where the electromotive force Uemf1 of the first coil equals the electromotive force Uemf2 of the second coil. This may be caused intentionally by design or unintentionally by tolerances.

By the disclosed measures, the coil arrangement is shifted to a desired idle position, which is characterized by the relation between the electromotive force Uemf1 of the first coil/a parameter derived thereof and the electromotive force Uemf2 of the second coil/said parameter derived thereof. This relation can be a particular ratio or a difference between said values. "Substantially" in the given context particularly means a deviation of ±10% from a reference value. However, it should be noted that the aim of the control method generally is a zero deviation from the reference value.

The desired idle position especially can be the magnetic zero position, in which the idle position of the membrane (x=0) coincides with the point where the electromotive force Uemf1 of the first coil equals the electromotive force Uemf2 of the second coil (i.e. a ratio between said values is substantially 1, respectively a difference between said values is substantially 0 then). In other words, the conjunction area between the voice coil in this case is held in a position, in which the magnetic field of the magnet system reaches a maximum.

By use of the proposed method/the proposed electronic offset compensation module/circuit, the membrane may be shifted into that position, which is intended as the idle position by design thereby compensating tolerances and improving the performance of the transducer in general. For example, distortions of the audio output of the transducer can be reduced in this way. Furthermore, symmetry may be improved thereby allowing for the same membrane stroke in forward and backward direction. In yet another application, algorithms for calculating a membrane position are improved by the proposed measures.

Generally, the control voltage should not interfere with sound output by the transducer, but should just compensate an offset position of the membrane in a more or less fast way. Accordingly, the control voltage beneficially is slow in comparison to the sound. In other words, a frequency of an alternating component of the control voltage beneficially is low in comparison to the frequencies of the sound. In case of micro speakers, a frequency of an alternating component of the control voltage may be 50 Hz. For other speakers this frequency may be 10 Hz. In view of a fast changing sound signal, the control voltage may be seen as a DC-voltage. In special cases, the control voltage indeed may be a DC-voltage. Alternatively, the control voltage may comprise an alternating component and a constant component.

Beneficially, the electromotive force Uemf1 of the first coil and the electromotive force Uemf2 of the second coil can be calculated by the formulas $$U_{emf1}=U_{in1}(t)-Z_{C1}\cdot I_{in}(t)$$

$$U_{emf2}=U_{in2}(t)-Z_{C2}\cdot I_{in}(t)$$

wherein $Z_{c1}$ is the (instantaneous) coil resistance of the first coil, $U_{in1}(t)$ is the input voltage to the first coil at the time t and $I_{in}(t)$ is the input current to the first coil at the time t. Accordingly, $Z_{c2}$ is the (instantaneous) coil resistance of the second coil, $Um_2(t)$ is the input voltage to the second coil at the time t and $I_{in}(t)$ is the input current to the second coil at the time t. It should be noted that the first and the second coil are connected in series so that the current $I_{in}(t)$ is the same for both coils.

Furthermore, it should be noted that $Z_{C1}$ and $Z_{C2}$ are complex numbers in the above formulas. However, for a simplified calculation also the (real valued and instantaneous) coil resistances of the first coil and the second coil $R_{C1}$ and $R_{C2}$ may be used instead of the complex values $Z_{C1}$ and $Z_{C2}$, thus neglecting capacitive/inductive components of the coil resistance. Accordingly, "$Z_{C1}$" may be changed to "$R_{C1}$", "$Z_{C2}$" may be changed to "$R_{C2}$" and "$Z_C$" may be changed to "$R_C$" in this disclosure. For the formulas for the electromotive force $U_{emf1}$ of the first coil and the electromotive force $U_{emf2}$ of the second coil for example this means $$U_{emf1}=U_{in1}(t)-R_{C1}\cdot I_{in}(t)$$

$$U_{emf2}=U_{in2}(t)-R_{C2}\cdot I_{in}(t)$$

It should also be noted that the coil resistance $Z_C$ is not necessarily constant over time, but may change in accordance with a coil temperature for example. For measuring the coil resistance $Z_C$ an (inaudible) tone or sine signal may be applied to the transducer. In case of a micro speaker such a tone or sine signal particularly may have a frequency below 100 Hz, for example 50 Hz. It should be noted that the coil resistance $Z_C$ slowly varies over time. That is why the coil resistance $Z_C$ is considered as to be constant in view of the fast variation of the input voltages $U_{in1}(t)$ and $U_{in2}(t)$ and in view of the input current to the second coil at the time t. However, strictly speaking the coil resistance may also be denoted with "$Z_C(t)$".

Beneficially, a parameter derived from the electromotive force $U_{emf1}$, $U_{emf2}$ is an absolute value of the electromotive force $U_{emf1}$, $U_{emf2}$, a square value of the electromotive force $U_{emf1}$, $U_{emf2}$ or a root mean square value of the electromotive force $U_{emf1}$, $U_{emf2}$. Accordingly, a control voltage may be applied to at least one of the voice coils and altered until

- an absolute value of the electromotive force $U_{emf1}$ of the first coil and an absolute value of the electromotive force $U_{emf2}$ of the second coil or
- a square value of the electromotive force $U_{emf1}$ of the first coil and a square value of the electromotive force $U_{emf2}$ of the second coil or
- a root mean square value of the electromotive force $U_{emf1}$ of the first coil and a root mean square value of the electromotive force $U_{emf2}$ of the second coil substantially reach a predetermined relation. In this way, the offset compensation method is based on a relation of the energy in the coils respectively based on a relation of a parameter derived from the energy in the coils due to the electromotive force. Especially if the predetermined relation is a predetermined ratio, mathematical operations may be applied to both the numerator and the denominator without changing the ratio.

In a very advantageous embodiment, a control voltage is applied to at least one of the voice coils and altered until the low pass filtered electromotive force Uemf1 of the first coil/a parameter derived thereof and the low pass filtered electromotive force Uemf2 of the second coil/said parameter derived thereof substantially reach a predetermined relation. In other words, the control voltage is applied to at least one of the voice coils and altered until the electromotive force Uemf1 of the first coil filtered by a first filter/a parameter derived thereof and the electromotive force Uemf2 of the second coil filtered by said first filter/said parameter derived thereof substantially reach a predetermined relation. Or a control voltage is applied to at least one of the voice coils and altered until the electromotive force Uemf1 of the first coil/a parameter derived thereof and the electromotive force Uemf2 of the second coil/said parameter derived thereof substantially reach a predetermined relation below a particular frequency. Concretely, the electromotive forces Uemf1 and Uemf2/parameters derived thereof can be determined in the whole audio band in a first step, the energy of the electromotive forces Uemf1 and Uemf2 respectively a parameter thereof can be determined in a second step, and the result of the second step can be low pass filtered by a filter in a third step before the signals obtained in the third step are used for application of the control voltage. In normal use, signals comprising a bunch of frequencies are fed into a transducer, e.g. ranging from 100 Hz to 20 kHz in case of a micro speaker and from 20 Hz to 20 kHz in case of other speakers. Without limiting the disclosed offset compensation method to low frequencies, e.g. by use of a low pass filter, application of the control voltage can foil the conversion of the applied signal. The border frequency of such a first filter may be 50 Hz in case of a micro speaker and 10 Hz case of other speakers. Further preferred values are 20 Hz in case of a micro speaker and 5 Hz case of other speakers.

Advantageously, a delta sigma modulation is used for applying a control voltage to at least one of the voice coils. In this case, a deviation from the target relation between the electromotive force Uemf1 of the first coil/a parameter derived thereof and the electromotive force Uemf2 of the second coil/said parameter derived thereof is summed with opposite sign and applied to the coil arrangement thus compensating the above deviation. A delta sigma modulator can also be considered as an integral controller, and other integration controllers may be used for the application of a control voltage to at least one of the voice coils as well.

In a preferred embodiment, the signal output by the delta sigma modulator is fed into a second filter before it is applied to the coil arrangement, thus reducing or avoiding instability in the control loop. As a result, the membrane is slowly modulated in order to swing around the desired idle position. The speed of this movement is defined by the lower limit frequency of said second filter. In general, the disclosed control loop can be realized by low order systems, but performance may be enhanced by use of higher order control systems, for example PID-control systems (proportional-integral-derivative control systems).

Generally, the control voltage can be applied to one of the voice coils of the coil arrangement. However, in a beneficial embodiment, the control voltage is applied to both the first coil and the second coil. In this way, the control voltage for shifting the coil arrangement to the desired idle position may be comparably low.

Beneficially, a sound signal is applied to both the first coil and the second coil during application of a control voltage. In this way, the offset compensation method is executed during normal use of the electrodynamic acoustic transducer and not just under laboratory conditions. It is equally imaginable to output sound to one of the coils and the control voltage to the other coil. Also in this case, a sound signal and the control signal are superimposed.

Advantageously, the transducer system comprises an electronic zero position detecting module/circuit, which is designed to be connected to a coil arrangement of the electrodynamic acoustic transducer, wherein the coil arrangement comprises two voice coils and wherein the electronic zero position detecting module/circuit is designed to a) measure a voltage U1 at the first coil and a second voltage U2 at the second coil;

b) calculate a ratio U1/U2 between the first voltage U1 and the second voltage U2 and c) determine the magnetic zero position of the membrane by detecting a state, in which the above ratio U1/U2 equals 1 and a gradient dU1/dU2 of the above ratio is negative.

Accordingly, an advantageous method for determining the magnetic zero position of a membrane of an electrodynamic acoustic transducer, in particular of a loudspeaker, having a coil arrangement with two voice coils, comprises the steps of a) measuring a voltage U1 at the first coil and a second voltage U2 at the second coil;

b) calculating a ratio U1/U2 between the first voltage U1 and the second voltage U2 and c) determining the magnetic zero position of the membrane by detecting a state, in which the above ratio U1/U2 equals 1 and a gradient dU1/dU2 of the above ratio is negative.

By the measures presented above, the magnetic zero position of the membrane can be detected, which inter alia may then be used for further calculations related to the transducer, e.g. for an algorithm for calculating the position of the membrane. No additional measurement equipment like a laser is needed for the detection of the membranes magnetic zero position.

To avoid a division by zero when calculating the ratio U1/U2 between the first voltage U1 and the second voltage U2, the ratio U1/U2 can be shifted by a constant value K, which is above the negative minimum of the second voltage U2 or below the negative maximum of the second voltage U2. In the first case the ratio U1/U2 is shifted upwards into an area, in which all values of the second voltage U2 are positive, and no value is zero. In the second case the ratio U1/U2 is shifted downwards into an area, in which all values of the second voltage U2 are negative, and no value is zero.

Accordingly, the method for detecting a magnetic zero position of the membrane comprises the steps of a) measuring a voltage U1 at the first coil and a second voltage U2 at the second coil;

b) calculating a ratio (U1+K)/(U2+K) between the first voltage U1 plus a constant value K and the second voltage U2 plus the constant value K, wherein the constant value K is above the negative minimum of the second voltage U2 or below the negative maximum of the second voltage U2 and c) determining the magnetic zero position of the membrane by detecting a state, in which the above ratio (U1+K)/(U2+K) equals 1 and a gradient d(U1+K)/d(U2+K) respectively dU1/dU2 of the above ratio is negative.

It is advantageous if in said state of step c) additionally the electromotive force $U_{emf1}$ of the first coil and/or the electromotive force $U_{emf2}$ of the second coil is positive. It has turned out that the calculated magnetic zero position best coincides with the real magnetic zero position of the membrane then. Nevertheless, it is also beneficial, if in said state of step c) the electromotive force $U_{emf1}$ of the first coil and/or the electromotive force $U_{emf2}$ of the second coil is negative.

Generally, the magnetic zero position determined in step c) can be used for an algorithm for calculating the position x of the membrane, concretely for initializing and/or resetting said calculation.

The disclosed measures, i.e. the offset compensation method and/or the zero detecting method, are of particular advantage in the context of methods or systems for calculating a position of the transducers membrane. For example, a method for calculating the excursion x of membrane of an electrodynamic acoustic transducer, in particular of a loudspeaker, comprises the steps of d) calculating a velocity v of the membrane based on an input voltage $U_{in}$ and an input current $I_{in}$ to a coil of the transducer and based on an idle driving force factor BL(0) of the transducer in an idle position of the membrane (obtained by means of the offset compensation method) or in the magnetic zero position of the membrane obtained in step c) (obtained by means of the zero position detecting method);

e) calculating a position x of the membrane by integrating said velocity v;

f) calculating the velocity v of the membrane based on the input voltage $U_{in}$ and the input current $I_{in}$ to the coil of the transducer and based on a driving force factor BL(x) of the transducer at the position x of the membrane calculated in step e) and g) recursively repeating steps e) and f).

In this context, also an calculation module/circuit is presented, which is designed to be connected to the coil arrangement of the electrodynamic acoustic transducer, wherein the coil arrangement comprises two voice coils and wherein the position calculation module/circuit is designed to d) calculate a velocity v of the membrane based on an input voltage $U_{in}$ and an input current $I_{in}$ to a coil of the transducer and based on an idle driving force factor BL(0) of the transducer in an idle position or a magnetic zero position of the membrane;

e) calculate a position x of the membrane by integrating said velocity v;

f) calculate the velocity v of the membrane based on the input voltage $U_{in}$ and the input current $I_{in}$ to the coil of the transducer and based on a driving force factor BL(x) of the transducer at the position x of the membrane calculated in step e) and to g) recursively repeat steps e) and f).

A (complete) method for determining the excursion x of the membrane by use of the zero position detecting method can comprise the steps of:

a) measuring a voltage U1 at the first coil and a second voltage U2 at the second coil;

b) calculating a ratio U1/U2 between the first voltage U1 and the second voltage U2 and d) calculating a velocity v of the membrane based on an input voltage $U_{in}$ and an input current $I_{in}$ to a coil of the transducer and based on a static driving force factor BL(0) of the transducer or recalling this velocity v from a memory when the above ratio U1/U2 equals 1 and a gradient dU1/dU2 of the above ratio is negative;

e) calculating a position x of the membrane by integrating said velocity v;

f) calculating the velocity v of the membrane based on the input voltage $U_{in}$ and the input current $I_{in}$ to the coil of the transducer and based on a driving force factor BL(x) of the transducer at the position x of the membrane calculated in step e) and g) recursively repeating steps a) to f).

In step d) the velocity v for x=0 may be calculated each time the magnetic zero position is detected. It may also be calculated once and stored in a memory. From there it can be recalled each time the magnetic zero position is detected. By the measures presented above, the position x of the membrane can be determined without the need of additional means in the transducer. Instead, just the coil is needed, which is part of an electrodynamic acoustic transducer anyway. By application of the control voltage as disclosed above, the integration of the membrane velocity starts at the intended idle position of the membrane. That is why the membrane position x can be calculated with high accuracy. Alternatively, the integration can start at a detected zero position, which allows calculating the membrane position x with high accuracy, too. Having the position of the membrane, non-linearity of the driving force factor BL(x) can be compensated, thus even more reducing distortions of the sound output by the electrodynamic acoustic transducer. In other words, sonic waves emanating from the transducer nearly perfectly fit to the electric sound signal being applied to the transducer. Alternatively, or in addition, the level of the electric sound signal may be limited, or it may be cut off at high membrane excursions x so as to avoid damages of transducer.

It should be noted that the membrane position x=0 can coincide with the idle position and/or the magnetic zero position, depending on which method the calculation of the membrane excursion x is based. If the position calculation method is based on the offset compensation method, the position x=0 coincides with the desired or obtained idle position. If the position calculation method is based on the zero detection method, the position x=0 coincides with the detected zero position. In special cases, the idle position coincides with the magnetic zero position. In this cases, the position x=0 coincides with both the desired or obtained idle position and the detected zero position.

In yet another beneficial embodiment, the velocity v, the input voltage Uin, the input current Iin, the idle driving force factor BL(0), the driving force factor BL(x) and the position x are related to the same point in time t. In this way, the position x of the membrane at a particular point in time may iteratively be calculated by recursively repeat steps e) and f) until a desired accuracy is obtained. For example, a deviation of positions x calculated in subsequent iterations respectively in subsequent steps f) can be calculated for determination of the obtained accuracy.

In another beneficial variant of the presented method, the velocity v, the input voltage $U_{in}$, the input current $I_{in}$, the idle driving force factor BL(0), the driving force factor BL(x) and the position x are related to different points in time t. In this way, the determination of the position x of the moving membrane is an ongoing process. Particularly, the method comprises the steps of d) calculating a velocity v(t) of the membrane based on an input voltage $U_{in}(t)$ and an input current $I_{in}(t)$ to a coil of the transducer and based on an idle driving force factor BL(0)

of the transducer in an idle position of the membrane (obtained by means of the offset compensation method) or in the magnetic zero position of the membrane obtained in step c) (obtained by means of the magnetic zero position detecting method);

e) calculating a position x(t) of the membrane by integrating said velocity v(t);

f) calculating the velocity v(t+1) of the membrane based on the input voltage $U_{in}(t+1)$ and the input current $I_{in}(t+1)$ to the coil of the transducer and based on a driving force factor BL(x(t)) of the transducer at the position x(t) of the membrane calculated in step e) and g) recursively repeating steps e) and f) wherein t gets t+1.

The method involves a phase shift and an error of the calculated membrane position x in view of the actual membrane position. However, this phase shift and this error may be kept low if the calculations are fast in relation to the moving speed of the membrane. Generally, the phase shift and the error are the lower the lower the frequency of the membrane is and the higher a clock frequency of a calculating device (e.g. the electronic position calculation module/circuit) is.

Beneficially, the position x of the membrane is calculated by the formula $$x(t)=x(t-1)+v(t)\cdot\Delta t$$

which is a numerical representation of $$x(t)=\int v(t)\cdot dt$$

Furthermore, it is advantageous, if the velocity v of the membrane is calculated by the formula $$v(t)=(U_{in}(t)-Z_C\cdot I_{in}(t))/BL(0) \text{ in step } d) \text{ or by}$$

$$v(t+1)=(U_{in}(t+1)-Z_C\cdot I_{in}(t+1))/BL(x(t)) \text{ in step } f)$$

In this way, the calculation is based on the electromotive force $U_{emf}$ of a coil, which can easily be calculated by $$U_{emf}=U_{in}(t)-Z_C\cdot I_{in}(t)$$

wherein $Z_C$ is the coil resistance (instead of $Z_C$, $R_C$ may be used for a less complicated calculation).

In an alternative variant of the presented method the velocity v of the membrane is calculated by the formula $$v(t+1)=v_(t+1)\cdot BL(0)/BL(x(t)) \text{ in step } f) \text{ wherein}$$

$$v_(t+1)=(U_{in}(t+1)-Z_C\cdot I_{in}(t+1))/BL(0)$$

Here, a rough approximation of the velocity v~ of the membrane is calculated with the idle driving force factor BL(0) in the idle position or zero position of the membrane in a first step, which is corrected then by a factor showing the relation between BL(0) and BL(x).

Beneficially, the velocity v of the membrane is calculated by use of the electromotive force Uemf1 of the first coil or the electromotive force Uemf2 of the second coil or the sum of the electromotive force Uemf1 of the first coil and the electromotive force Uemf2 of the second coil.

Depending on which coil resistance and which driving force factor is known, the velocity v of the membrane can be calculated by use of one or more of the following formulas:

$$v(t)=(U_{in1}(t)-Z_{C1}\cdot I_{in}(t))/BL1$$

$$v(t)=(U_{in2}(t)-Z_{C2}\cdot I_{in}(t))/BL2$$

$$v(t)=(U_{in1}(t)+U_{in2}(t)-(Z_{C1}+Z_{C2})\cdot I_{in}(t))/BL12$$

wherein BL12 is the driving force factor of the whole coil arrangement.

The proposed methods and modules/circuits particularly apply to micro speakers, whose membrane area is smaller than 300 $mm^2$. Such micro speakers are used in all kind of mobile devices such as mobile phones, mobile music devices and/or in headphones.

Generally, the amplifier for the transducer may be part of an electronic driving circuit. This electronic driving circuit may additionally comprise one or more members of the group: electronic offset calculation module, electronic position calculation module, electronic zero detection module. In this disclosure, a "module" in the above context means a part of the electronic driving circuit. Although it is beneficial to have the above referenced modules in the electronic driving circuit, one or more of the functions performed by the modules may be done by a circuit out of the electronic driving circuit. That means that one or more of the group: electronic offset calculation circuit, electronic position calculation circuit, electronic zero detection circuit may exist out of the electronic driving circuit. Accordingly, a "circuit" performing one of the above functions is out of the electronic driving circuit. Nevertheless, an electronic offset calculation circuit, an electronic position calculation circuit and an electronic zero detection circuit may be part of a transducer system. At this point it should be noted that the connection point between two voice coils may be connected (just) to an input of an electronic driver circuit or to an input of a further electronic circuit, concretely of an electronic offset calculation circuit, an electronic position calculation circuit and/or an electronic zero detection circuit. Furthermore, it should be noted at this point that the various embodiments for the method and the advantages related thereto equally apply to the disclosed electronic circuits and the transducer system and vice versa.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
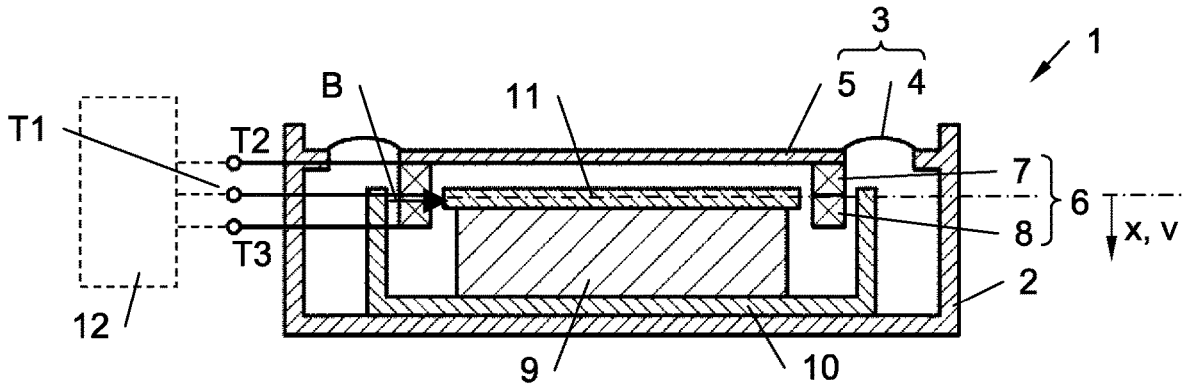
FIG. 1 shows a cross sectional view of an exemplary transducer.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about" or "substantially", which particularly means a deviation of ±10% from a reference value.

FIG. 1 shows an example of an electrodynamic acoustic transducer 1, which may be embodied as a loudspeaker, in cross sectional view. The transducer 1 comprises a housing 2 and a membrane 3 having a bending section 4 and a center section 5, which is stiffened by a plate in this example. Furthermore, the transducer 1 comprises a coil arrangement 6 attached to the membrane 3. The coil arrangement 6 comprises a first coil 7 and a second coil 8. The first coil 7 is arranged on top of the second coil 8 and concentric to the second coil 8 in this example. Furthermore, the transducer 1 comprises a magnet system with a magnet 9, a pot plate 10 and a top plate 11. The magnet system generates a magnetic field B transverse to a longitudinal direction of a wound wire of the coil arrangement 6.

Additionally, the electrodynamic acoustic transducer 1 comprises three connection taps/terminals T1 . . . T3 electrically connected to the coils 7, 8 and connected to an electronic driving circuit 12. Terminals T2 and T3 are outer terminals, and terminal T1 is a connecting terminal connecting the coils 7, 8. The electrodynamic acoustic transducer 1 and the electronic driving circuit 12 form a transducer system.

The excursion of the membrane 3 is denoted with "x" in the example shown in FIG. 1, its velocity with "v". As known, a current through the coil arrangement 6 causes a movement of the membrane 3 and thus sound, which emanates from the transducer 1.

Figure 2:
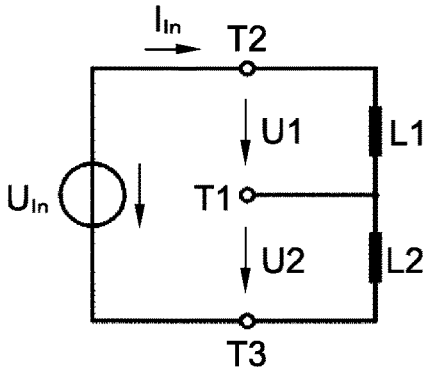
FIG. 2 shows a simplified circuit diagram of the transducer 1 shown in FIG. 1.

FIG. 2 shows a simplified circuit diagram of the transducer 1 shown in FIG. 1. Concretely, FIG. 2 shows a voltage source, generating the voltage UIn, which is fed to a serial connection of a first inductance L1, which is formed by the first voice coil 7, and a second inductance L2, which is formed by the second voice coil 8.

A method for determining the magnetic zero position MP of the membrane 3 comprises the steps of a) measuring a voltage U1 at the first coil 7 and a second voltage U2 at the second coil 8;

b) calculating a ratio U1/U2 between the first voltage U1 and the second voltage U2 and c) determining the magnetic zero position of the membrane 3 by detecting a state, in which the above ratio U1/U2 equals 1 and a gradient dU1/dU2 of the above ratio is negative.

Figure 3:
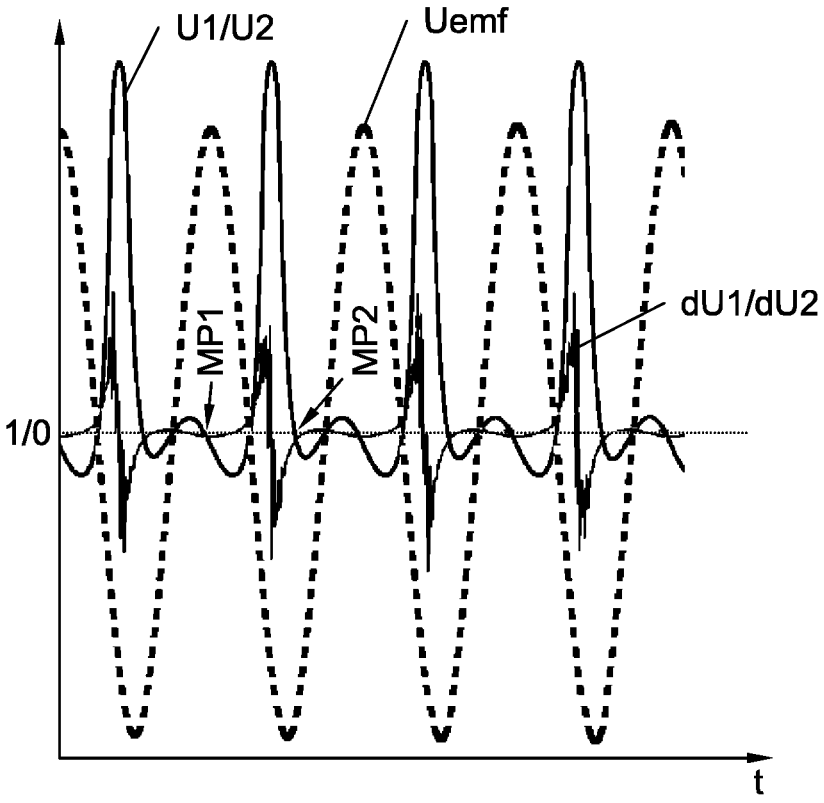
FIG. 3 shows an exemplary graph of the ratio U1/U2, the gradient dU1/dU2 of the ratio and the electromotive force Uemf.

In this context, FIG. 3 shows an exemplary graph of the ratio U1/U2 and the gradient dU1/dU2 of a transducer 1. The graph of the ratio U1/U2 oscillates with the double frequency of the membrane 3 and becomes 1 four times in an oscillation period. Two points refer to "real" magnetic zero positions of the membrane 3, i.e. the points MP1 and MP2, where the gradient dU1/dU2 of the above ratio is negative. Accordingly, the magnetic zero position MP of the membrane 3 can be determined as defined in step c). It should be noted at this point that the graph for the gradient dU1/dU2 is shifted upwards by 1 so as to get a concise picture of the situation.

It has turned out that the calculated zero position MP1 best coincides with the real magnetic zero position of the membrane 3. Accordingly, it is advantageous if in said state of step c) additionally the electromotive force $U_{emf1}$ of the first coil 7 and/or the electromotive force $U_{emf2}$ of the second coil 8 is positive. This state is denoted with the point MP1 in FIG. 3. It should be noted at this point that also graph for the electromotive force $U_{emf}$ is shifted upwards by 1 so as to get a concise picture of the situation.

Despite the calculated magnetic zero position MP1 best coincides with the real magnetic zero position of the membrane 3, in said state of step c) also the electromotive force $U_{emf1}$ of the first coil 7 and/or the electromotive force $U_{emf2}$ of the second coil 8 can be negative. This state is denoted with the point MP2 in FIG. 3.

To avoid a division by zero when calculating the ratio U1/U2 between the first voltage U1 and the second voltage U2, the graph of the ratio U1/U2 can be shifted by a constant value K, which is above the negative minimum of the second voltage U2 or below the negative maximum of the second voltage U2. In the first case the graph is shifted upwards into an area, in which all values of the second voltage U2 are positive, and no value is zero. In the second case the graph is shifted downwards into an area, in which all values of the second voltage U2 are negative, and no value is zero.

Accordingly, the method for detecting an magnetic zero position MP of the membrane 3 comprises the steps of a) measuring a voltage U1 at the first coil 7 and a second voltage U2 at the second coil 8;

b) calculating a ratio (U1+K)/(U2+K) between the first voltage U1 plus a constant value K and the second voltage U2 plus the constant value K, wherein the constant value K is above the negative minimum of the second voltage U2 or below the negative maximum of the second voltage U2 and c) determining the magnetic zero position MP1, MP2 of the membrane 3 by detecting a state, in which the above ratio (U1+K)/(U2+K) equals 1 and a gradient d(U1+K)/d(U2+K) respectively dU1/dU2 of the above ratio is negative.

Generally, the magnetic zero position MP1, MP2 determined in step c) can be used for an algorithm for calculating the position x of the membrane 3, concretely for initializing and/or resetting said calculation.

Figure 4:
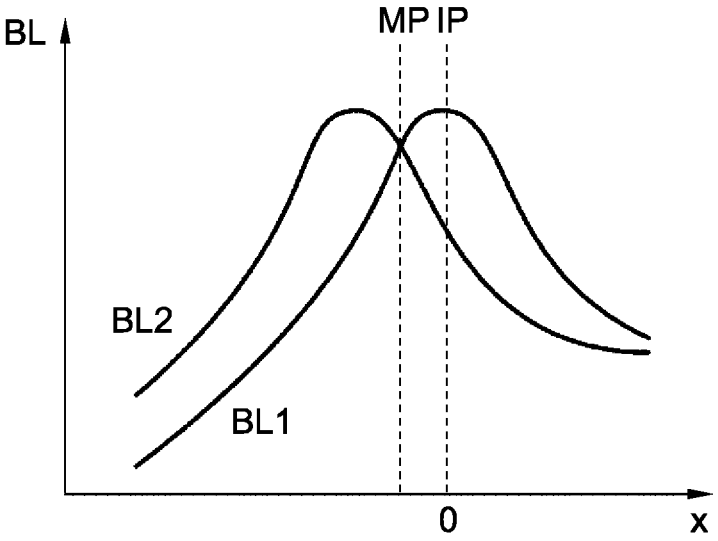
FIG. 4 shows exemplary graphs of the driving force factors of the first and the second coil of the transducer shown in FIG. 1 and FIG. 5 a more detailed embodiment of a transducer system.

In this context, FIG. 4 shows a graph of a first driving force factor BL1 of the first voice coil 7 and a graph of a second driving force factor BL2 of the second voice coil 8. The driving force factors BL1 and BL2 may be measured as it is known in prior art. In particular, FIG. 4 also shows the magnetic zero position MP of the membrane 3 and its desired idle position IP, which differs from the magnetic zero position MP in this example.

A method for calculating the excursion x of membrane 3 is now as follows:

In a first step d), a velocity v of the membrane 3 is calculated based on an input voltage $U_{in}$ and an input current $I_{in}$ to the coils 7, 8 of the transducer 1 and based on an idle driving force factor BL1(0), BL2(0) of the transducer 1 in a magnetic zero position MP1, MP2 respectively in an idle position IP (where x=0 or assumed to be 0) of the membrane 3.

The velocity v of the membrane 3 may be calculated by the formula $$v(t)=(U_{in}(t)-Z_C\cdot I_{in}(t))/BL(0)$$

wherein $Z_C$ is the coil resistance.

Generally, the velocity v of the membrane 3 can be calculated by use of the electromotive force Uemf1 of the first coil 7 or the electromotive force Uemf2 of the second coil 8 or the sum of the electromotive force Uemf1 of the first coil 7 and the electromotive force Uemf2 of the second coil 8.

In a first example the electromotive force $U_{emf1}$ of the first coil 7 is used as a basis for the calculation. The electromotive force $U_{emf1}$ is calculated as follows:

$$U_{emf1}=U_{in1}(t)-Z_{C1}\cdot I_{in}(t)$$

Accordingly, the velocity is $$v(t)=(U_{in1}(t)-Z_{C1}\cdot I_{in}(t))/BL1(0)$$

In a second step e), the position x of the membrane 3 is calculated by integrating said velocity v. Either by $$x(t)=\int v(t)\cdot dt$$

or by $$x(t)=x(t-1)+v(t)\cdot\Delta t$$

In a next step f), the velocity v of the membrane 3 is calculated based on the input voltage $U_{in}$ and the input current $I_{in}$ to the coil 7 of the transducer 1 and based on a driving force factor BL(x) of the transducer 1 at the position x of the membrane 3 calculated in step e). In our example the velocity v is calculated by the formula $$v(t)=(U_{in1}(t)-Z_{C1}\cdot I_{in}(t))/BL1(x(t))$$

Steps e) and f) are recursively repeated until a desired accuracy is obtained.

In the above example, the velocity v, the input voltage Uin, the input current Iin, the idle driving force factor BL(0), the driving force factor BL(x) and the position x are related to the same point in time t. That means, that a sample of the input voltage Uin, the input current Iin is taken once, and the position x is calculated in several iterations.

However, the velocity v, the input voltage Uin, the input current Iin, the idle driving force factor BL(0), the driving force factor BL(x) and the position x may also be related to different points in time t. If so, steps f) and g) are altered. In step f), the velocity v(t+1) of the membrane 3 based on the input voltage Uin(t+1) and the input current Iin(t+1) to the coil 7 of the transducer 1 and based on a driving force factor BL(x(t)) of the transducer 1 at the position x(t) of the membrane 3 is calculated. In our example using the first coil 7 this means $$v(t+1)=(U_{in}(t+1)-Z_C\cdot I_{in}(t+1))/BL(x(t))$$

Accordingly, steps e) and f) are recursively repeated wherein t gets t+1. In this way, the calculation of the position x is an ongoing process, whose accuracy basically depends on how fast the calculation is in relation to the velocity v of the membrane 3. In simple words this means that the calculation of the position x is the more accurate the lower the frequency of the signal driving the membrane 3 is.

As an alternative to the methods presented hereinbefore, the calculation of the velocity v of the membrane 3 may be done with the idle driving force factor BL(0) in the magnetic zero position MP1, MP2 respectively in the idle position IP of the membrane 3 in a first step, which is corrected then by a factor showing the relation between BL(0) and BL(x). Accordingly, the velocity v of the membrane 3 can be calculated by the formula $$v(t+1)=v_(t+1)\cdot BL(0)/BL(x(t)) \text{ in step } f) \text{ wherein}$$

$$v_(t+1)=(U_{in}(t+1)-Z_C\cdot I_{in}(t+1))/BL(0)$$

Here, v~ is a rough approximation of the velocity of the membrane 3 calculated with the use of the idle driving force factor BL(0) in the magnetic zero position MP1, MP2 respectively in the idle position IP of the membrane 3. This velocity then is corrected by use of the factor BL(0)/BL(x (t)).

In real applications, the idle position IP of the membrane 3 (x=0) often does not coincide with the point where the electromotive force $U_{emf1}$ of the first coil 7 equals the electromotive force $U_{emf2}$ of the second coil 8, i.e. the magnetic zero position MP. This leads to a deviation of the calculated position x of the membrane 3 from the real position of the membrane 3.

In other words, the conjunction area between the first coil 7 and the second coil 8 is not in the same plane as the top plate 11. This deviation may be caused by a specific design and/or tolerances during manufacturing.

To avoid or reduce this deviation, a control voltage can be applied to at least one of the voice coils 7, 8 and altered until the electromotive force Uemf1 of the first coil 7 and the electromotive force Uemf2 of the second coil 8 substantially reach a predetermined relation and until the coil arrangement reaches a desired idle position IP. The electromotive force Uemf1 of the first coil 7 and the electromotive force Uemf2 of the second coil 8 can be calculated by the formulas $$U_{emf1}=U_{in1}(t)-Z_{C1}\cdot I_{in}(t)$$

$$U_{emf2}=U_{in2}(t)-Z_{C2}\cdot I_{in}(t)$$

Generally, said relation can be a particular ratio or a difference between said values. Particularly, the desired idle position IP can be the magnetic zero position MP, in which the idle position IP of the membrane (x=0) coincides with the point where the electromotive force $U_{emf1}$ of the first coil equals the electromotive force $U_{emf2}$ of the second coil. In this particular point a ratio between said values is substantially 1, respectively a difference between said values is substantially 0. The application of the control voltage may also be based on a parameter derived from the electromotive force $U_{emf1}$, $U_{emf2}$. Beneficially, said parameter is an absolute value of the electromotive force $U_{emf1}$, $U_{emf2}$, a square value of the electromotive force $U_{emf1}$, $U_{emf2}$ or a root mean square value of the electromotive force $U_{emf1}$, $U_{emf2}$.

Accordingly, the control voltage may be applied to at least one of the voice coils 7, 8 and altered until a (root mean) square value of the electromotive force $U_{emf1}$ of the first coil 7 and a (root mean) square value of the electromotive force $U_{emf2}$ of the second coil 8 substantially reach a predetermined relation. Alternatively, the control voltage may be applied to at least one of the voice coils 7, 8 and altered until an absolute value of the electromotive force $U_{emf1}$ of the first coil 7 and an absolute value of the electromotive force $U_{emf2}$ of the second coil 8 reach a predetermined relation. It should be noted that the offset compensation method may also be based on a relation of other parameters derived from the electromotive forces $U_{emf1}$, $U_{emf2}$.

Particularly, the electromotive forces Uemf1 and Uemf2/parameters derived thereof are determined in the whole audio band in a first step, the energy of the electromotive forces Uemf1 and Uemf2 respectively a parameter thereof is determined in a second step, and the result of the second step is low pass filtered by a first filter, which may be part of an offset calculation module/circuit. Finally, the signals obtained in the third step are used for application of the control voltage UCTRL. For example, the cut off frequency of said low pass filter is 50 Hz in case of a micro speaker and 10 Hz case of other speakers. Preferably, the cut off frequency is 20 Hz in case of a micro speaker and 5 Hz case of other speakers. Thus, a frequency of an alternating component of the control voltage UCTRL is low in comparison to the frequencies of the sound output by the transducer 1. Generally, the control voltage UCTRL may comprise a constant component and an alternating component. In special cases, the control voltage UCTRL may also be a pure DC-voltage. The control voltage is applied to at least one of the voice coils 7, 8 and altered until the electromotive force Uemf1 of the first coil 7/a parameter derived thereof substantially equals the electromotive force Uemf2 of the second coil 8/said parameter derived thereof below the above frequencies.

The above-mentioned filter structures illustrate the inertial behavior of the control loop. A realization of the control loop may be based on state of the art control loop theory based on PID controller (proportional-integral-derivative controller) of arbitrary order.

In the examples presented hereinbefore, the electromotive force Uemf1 of the first coil 7 was used to determine an excursion x of the membrane 3. However, in the same way the electromotive force Uemf2 of the second coil 8 or the sum of the electromotive force Uemf1 of the first coil 7 and the electromotive force Uemf2 of the second coil 8 may be used for this reason. If so, $$v(t)=(U_{in2}(t)-Z_{C2}\cdot I_{in}(t))/BL2$$

or $$v(t)=(U_{in1}(t)+U_{in2}(t)-(Z_{C1}+Z_{C2})\cdot I_{in}(t))/BL12$$

may be used for the calculation of the velocity v of the membrane 3, wherein BL12 is the driving force factor of the complete coil arrangement 6.

The calculations presented hereinbefore as well as the application of a control voltage UCTRL to the coil arrangement 6 generally may be done by the driving circuit 12. The driving circuit 12 may be a standalone device or may be integrated into another device.

The presented method for calculating the position x of the membrane 3 can be used to compensate non-linearities of the transducer 1. For example, the non-linear graph of the driving force factor BL (see FIG. 4) leads to a non-linear conversion of the electric signals fed to the coil arrangement 6 into a movement of the membrane 3. Knowing the position x of the membrane 3, this non-linearity can be compensated by altering the electric signals.

Figure 5:
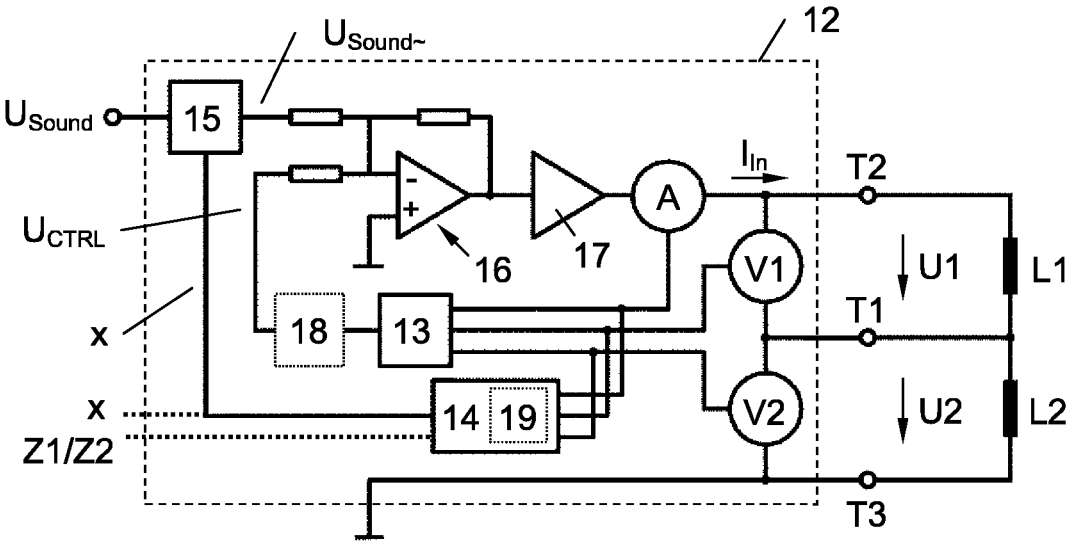

FIG. 5 now shows a more concrete embodiment of a transducer system, particularly of the electronic driving circuit 12 connected to the coil arrangement 6, which is shown by the inductances L1 and L2 in FIG. 5. The electronic driving circuit 12, comprises an offset calculation module 13, a position calculation module 14, a sound signal changing module 15, a mixer 16 and a power amplifier 17.

The offset calculation module 13 is connected to a current measuring device A, and a first voltage measuring device V1 and a second voltage measuring device V2. As explained above, the electromotive force $U_{emf1}$ of the first coil 7 and the electromotive force $U_{emf2}$ of the second coil 8 can be calculated based on the input current $I_{in}(t)$ to the first coil 7 and the second coil 8, which is measured with the current measuring device A, the input voltage $U_{in1}(t)$ to the first coil 7, which is measured with the first voltage measuring device V1, the input voltage $U_{in2}(t)$ to the second coil 8, which is measured with the second voltage measuring device V2, and the coil resistance $Z_{C1}$ of the first coil 7 and the coil resistance $Z_{C2}$ of the second coil 8, which are considered to be known from a separate measurement. Based on this information, the offset calculation module 13 calculates a control voltage $U_{CTRL}$, which is applied to the coils 7 and 8.

The offset calculation module 13 especially may comprise a delta sigma modulator which does the offset compensation according to a delta sigma modulation. In this case, a deviation from the target relation between the electromotive force $U_{emf1}$ of the first coil 7 and the electromotive force $U_{emf2}$ of the second coil 8 is summed with opposite sign and applied to the coil arrangement 6 thus compensating the above deviation and thus heading for the desired idle position IP. A delta sigma modulator can also be considered as an integral controller, and other integration controllers may be used in the offset calculation module 13 as well. The application of the control voltage $U_{CTRL}$ by the offset calculation module 13 may also be based on a parameter derived from the electromotive force $U_{emf1}$, $U_{emf2}$ as disclosed hereinbefore.

In addition to an optional first filter in the offset calculation module 13 a second filter 18 may be arranged downstream of the offset calculation module 13. The first filter avoids that the offset calculation module 13 interferes with the sound output of the transducer 1. The second filter 18 reduces or avoids instability in the control loop.

As explained above, also the position x can be calculated by use of the input current $I_{in}(t)$ to the first coil 7 and the second coil 8, the input voltage $U_{in1}(t)$ to the first coil 7, the input voltage $U_{in2}(t)$ to the second coil 8 as well as the driving force factor BL(x) of the transducer 1. This job is performed by the position calculation module 14, which calculates the position x of the membrane 3 and in this example outputs it to the sound signal changing module 15. The sound signal changing module 15 compensates nonlinearity in the driving force factor BL(x) (see FIG. 4) based on the membrane position x. Concretely, the sound signal changing module 15 alters the input sound signal $U_{Sound}$ based on the membrane position x and the driving force factor BL(x) and outputs an altered sound signal $U_{Sound\sim}$ so that sound emanating from the transducer 1 fits to the sound signal $U_{Sound}$ as best as possible, and distortions are kept low. Alternatively or in addition, the level of the sound signal $U_{sound}$ may be limited, or it may be cut off by the sound signal changing module 15 at high membrane excursions x so as to avoid damages of transducer 1. Of course, the membrane position x may also be used for other controls and output to external electronic circuits.

It should be noted at this point that shifting the idle position IP of the membrane 3 does not necessarily involve the position calculation as presented above. Shifting the idle position IP of the membrane 3 may simply be based on altering the desired relation between the electromotive force Uemf1 of the first coil 7 and the electromotive force Uemf2 of the second coil 8 or based on altering a desired relation of parameters derived from the electromotive forces Uemf1, Uemf2.

It should also be noted that in the example shown in FIG. 5 both the position calculation module 14 and the sound signal changing module 15 comprise information about the driving force factor BL(x). In the position calculation module 14 this information is used to calculate the membrane position x, whereas in the sound signal changing module 15 the sound signal USound is altered by use of the driving force factor BL(x). Of course, both functions can be integrated into a single module, and of course the sound signal changing module 15 can also comprise other information about the transducer 1 up to a complete model so as to avoid distortions when converting the sound signal USound into sound.

In the example shown in FIG. 5, the control voltage UCTRL is mixed with the altered sound signal USound~ by the mixer 16. Finally, the mixed signal is amplified by the power amplifier 17 and applied to the transducer 1. Because of the mixer 16, the altered sound signal USound~ is applied during application of a control voltage UCTRL.

Generally, the amplifier 17 may be an unipolar amplifier having one sound output and a connection to ground. In this case one outer tap/terminal T2 of the coil arrangement 6/serially connected voice coils 7, 8 is electrically connected to the audio output of the amplifier 17, the other tap/terminal T3 is connected to ground. However, the amplifier 17 may also be a bipolar one having two dedicated sound outputs. In this case one outer tap/terminal T2 of the coil arrangement 6/serially connected voice coils 7, 8 is electrically connected to a first audio output of the amplifier 17, the other tap/terminal T3 is connected to the other second audio output. Generally, the amplifier 17 may have more amplification stages. In this case, the outputs of the intermediate stages are not considered to have an "audio output" for the concerns of this disclosure. The "audio output" is the output of the very last stage, which finally is connected to the transducer 1.

It should be noted that the electronic driving circuit 12 just shows the general function by use of functional blocks for illustrating purposes. Putting the disclosed functions into practice may need amendments of the electronic driving circuit 12 and more detailed electronics. Functional blocks do not necessarily coincide with physic blocks in a real driving circuit 12. A real physic block may incorporate more than one of the functions shown in FIG. 5. Moreover, dedicated functions of the functions shown in FIG. 5 may also be omitted in a real driving circuit 12, and a real driving circuit 12 may also perform more than the discloses functions.

For example, the position calculating module 14 and the sound signal changing module 15 may be omitted. In this case, the sound signal USound is applied to the transducer unchanged. In a further example, just the sound signal changing module 15 is omitted. In this case the position calculating module 14 may output the position x to an external sound signal changing circuit (see dotted line in FIG. 5). One skilled in the art will also easily realize that the power amplification and the mixing can be done with just one amplifier.

In this example, both the control voltage UCTRL and the altered sound signal USound~ are applied to both the first coil 7 and the second coil 8, i.e. to an outer tap/terminal T2 of the coil arrangement 6. Nevertheless, this is an advantageous solution, it is not the only one. In an alternate embodiment, the control voltage UCTRL is applied just to the first coil 7 and the (altered) sound signal USound~ is applied to just the second coil 8. In this case, a mixer 16 can be omitted as the control voltage UCTRL and the altered sound signal USound~ are superimposed by the movement of the membrane 3.

Instead of heading for compensating an offset by application of the control voltage UCTRL, the zero detection method can be used for calculating the membrane position x. In this case, the position calculation module 14 can also comprise the function of a zero detection module 19 and thus can be termed as "combined zero detection and position calculation module". As disclosed above, step d) of the position calculation method can be based on the magnetic zero position MP of the membrane 3 obtained in step c) then. The magnetic zero positions MP1 and/or MP2 are not just for calculating the membrane position, but can also be output to an external circuit (see dotted line in FIG. 5).

In summary, the electronic driving circuit 12, depending on which functions it comprises, provides a proper solution for feeding a sound signal USound to a transducer 1 while keeping distortions low and while avoiding damage of the transducer 1. In combination with the transducer 1 an advantageous transducer system is presented which allows for easy operation. A user just needs to feed a signal to be converted into sound to the transducer system and does not need to care about distortions and/or avoiding damage of the transducer 1. Preferably, the electronic driving circuit 12 and the transducer 1 are embodied as a single device or module. For example, the electronic driving circuit 12 can be arranged in the housing 2 of the transducer 1.

Although it is beneficial to have the above referenced modules in the electronic driving circuit 12, one should note that the driving circuit may just comprise the amplifier 17 in an alternative embodiment. In this case the electronic driving circuit 12 and the amplifier 17 may denote one and the same device.

Generally, the transducer 1 respectively the membrane 3 may have any shape in a top view, in particular a rectangular, circular or ovular shape. Furthermore, the coils 7 and 8 may have the same height or different heights, the same diameter or different diameters as well as the same number of winding or different numbers of windings.

It should be noted that although avoiding an offset of the membrane 3 was just disclosed in the advantageous context with the calculation of a membrane position x, avoiding an offset of the membrane 3 is not limited to this particular application. In contrast, it may also be used for simply shifting the membrane 3 into that position, which is intended as the idle position IP by design thereby compensating tolerances and improving the performance of the transducer 1 in general. Accordingly, distortions of the audio output of the transducer 1 can be reduced and/or symmetry may be improved thereby allowing for the same membrane stroke in forward and backward direction. The membrane 3 may also be shifted to an altered desired idle position IP so as to alter the sound characteristics of the transducer 1.

It should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention.

Particularly, it should be noted that the offset compensation method and the electronic offset compensation module/circuit 13 for obtaining a desired idle position IP as well as a transducer system comprising such an offset compensation module/circuit module 13 (that is to say the features of any one of claims 5 and 10-18) can form the basis of an independent invention without the limitations of claims 1 and 8.

Furthermore, it should be noted that the zero detection method and the electronic zero detection module/circuit 19 for detecting a magnetic zero position MP of the membrane 3 as well as a transducer system comprising such a zero detection module/circuit module 19 (that is to say the features of any one of claims 6 and 19-23) can form the basis of an independent invention without the limitations of claims 1 and 8.

Finally, it should be noted that the position calculation method and the electronic position calculation module/circuit 14 for calculating a position x of the membrane 3 as well as a transducer system comprising such a position calculation module/circuit module 15 (that is to say the features of any one of claims 7 and 24-32) can form the basis of an independent invention without the limitations of claims 1 and 8.

Anyway, the scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

LIST OF REFERENCES

1 electrodynamic acoustic transducer
2 housing
3 membrane
4 bending section
5 stiffened center section
6 coil arrangement
7 first coil
8 second coil
9 magnet
10 pot plate
11 top plate
12 electronic driving circuit
13 offset calculation module/circuit (with optional first filter)
14 position calculation module/circuit
15 sound signal changing module
16 mixer
17 (power) amplifier
18 second filter
19 electronic zero detection module/circuit
A current measuring device
B magnetic field
BL driving force factor
BL1 driving force factor of the first coil
BL2 driving force factor of the second coil
$I_{In}$ input current
L1 inductance of the first coil
L2 inductance of the second coil
MP . . . MP2 magnetic zero position
IP desired idle position
T1 . . . T3 connection terminals/taps
U1 voltage at the first coil
U2 voltage at the second coil
$U_{CTRL}$ control voltage
$U_{In}$ input voltage
$U_{Sound}$ sound signal
$U_{Sound\sim}$ altered sound signal
v membrane velocity
V1 first voltage measuring device
V2 second voltage measuring device
x membrane excursion
dU1/dU2 gradient of the ratio between first voltage and second voltage
t time

What is claimed is:

1. Transducer system, comprising:

an electrodynamic acoustic transducer with a membrane;

a coil arrangement attached to the membrane, wherein the coil arrangement comprises two voice coils electrically connected in series;

a magnet system being designed to generate a magnetic field transverse to a longitudinal direction of a wound wire of the coil arrangement;

a tap/terminal of the coil arrangement /serially connected voice coils being electrically connected to an audio output of an amplifier; and an electronic offset compensation module/circuit connected to the coil arrangement, and configured to apply a control voltage $U_{CTRL}$ to at least one of the voice coils and to alter said control voltage $U_{CTR}$ until the electromotive force $U_{emf1}$ of the first coil or a parameter derived thereof and the electromotive force $U_{emf2}$ of the second coil or said parameter derived thereof substantially reach a predetermined relation.

2. Transducer system according to claim 1, wherein the amplifier is the only amplifier electrically connected to the coil arrangement.

3. Transducer system according to claim 1, wherein a connection point between two voice coils is electrically connected to an input of the amplifier.

4. Transducer system according to claim 1, comprising an electronic zero detection module/circuit, which is designed to be connected to the coil arrangement of the electrodynamic acoustic transducer, and wherein the electronic zero detection module/circuit is designed to a) measure a voltage U1 at the first coil and a second voltage U2 at the second coil;

b) calculate a ratio U1/U2 between the first voltage U1 and the second voltage U2 and c) determine the magnetic zero position of the membrane by detecting a state, in which
the above ratio U1/U2 equals 1 and
a gradient dU1/dU2 of the above ratio is negative.

5. Transducer system according to claim 1, comprising an position calculation module/circuit, which is designed to be connected to the coil arrangement of the electrodynamic acoustic transducer, wherein the position calculation module/circuit is designed to d) calculate a velocity of the membrane based on an input voltage $U_{in}$ and an input current $I_{in}$ to a coil of the transducer and based on an idle driving force factor of the transducer in an idle position or in a magnetic zero position of the membrane;

e) calculate a position of the membrane by integrating said velocity;

f) calculate the velocity of the membrane based on the input voltage $U_{in}$ and the input current $I_{in}$ to the coil of the transducer and based on a driving force factor BL(x) of the transducer at the position of the membrane calculated in step e) and to g) recursively repeat steps e) and f).

6. Method for feeding a sound signal to an electrodynamic acoustic transducer with a membrane, a coil arrangement attached to the membrane, wherein the coil arrangement comprises a plurality of voice coils, in particular two voice coils, electrically connected in series and arranged in-between first and second outer taps/terminals, and a magnet system being designed to generate a magnetic field transverse to a longitudinal direction of a wound wire of the coil arrangement, wherein the coil arrangement is driven by sound signals fed only to one of the outer taps/terminals of the coil arrangement/serially connected voice coils, and wherein a control voltage $U_{CTRL}$ is applied to at least one of the voice coils and altered until the electromotive force $U_{emf1}$ of the first coil or a parameter derived thereof and the electromotive force $U_{emf2}$ of the second coil or said parameter derived thereof substantially reach a predetermined relation.

7. Method as claimed in claim 6, wherein the sound signals are fed to one of the outer taps/terminals of the serially connected voice coils by a single amplifier.

8. Method as claimed in claim 6, wherein the control voltage is applied to one of the outer taps/terminals of the serially connected voice coils.

9. Method as claimed in claim 6, wherein the electromotive force $U_{emf1}$ of the first coil and the electromotive force $U_{emf2}$ of the second coil are calculated by the formulas ti $U_{emf1}=U_{in1}(t)-Z_{C1}\cdot I_{in}(t)$ ti $U_{emf2}=U_{in2}(t)-Z_{C2}\cdot I_{in}(t)$ wherein $Z_{c1}$ is the coil resistance of the first coil, $U_{in1}(t)$ is the input voltage to the first coil at the time t and $I_{in}(t)$ is the input current to the first coil at the time t and wherein $Z_{C2}$ is the coil resistance of the second coil, $U_{in2}(t)$ is the input voltage to the second coil at the time t and $I_{in}(t)$ is the input current to the second coil at the time t.

10. Method as claimed in claim 6, wherein a parameter derived from the electromotive force $U_{emf1}$, $U_{emf2}$is an absolute value of the electromotive force $U_{emf1}$, $U_{emf2}$, a square value of the electromotive force $U_{emf1}$, $U_{emf2}$ or a root mean square value of the electromotive force $U_{emf1}$, $U_{emf2}$.

11. Method as claimed in claim 6, wherein the control voltage $U_{CTRL}$ is applied to at least one of the voice coils and altered until the low pass filtered electromotive force $U_{emf1}$ of the first coil or a parameter derived thereof and the low pass filtered electromotive force $U_{emf2}$ of the second coil or said parameter derived thereof substantially reach a predetermined relation.

12. Method as claimed in claim 6, wherein a delta sigma modulator is used for applying a control voltage $U_{CTRL}$ to at least one of the voice coils.

13. Method as claimed in claim 12, wherein a signal output of the delta sigma modulator is filtered before it is applied to the coil arrangement.

14. Method as claimed in claim 6, wherein a control voltage $U_{CTRL}$ is applied to both the first coil and the second coil.

15. Method as claimed in claim 6, wherein a sound signal is applied to the first coil and/or the second coil during application of a control voltage $U_{CTRL}$.

16. Method as claimed in claim 6 comprising the steps of:

a) measuring a voltage U1 at the first coil and a second voltage U2 at the second coil;

b) calculating a ratio U1/U2 between the first voltage U1 and the second voltage U2 and c) determining a magnetic zero position of the membrane by detecting a state, in which
the above ratio U1/U2 equals 1 and
a gradient dU1/dU2 of the above ratio is negative.

17. Method as claimed in claim 6 comprising the steps of a) measuring a voltage U1 at the first coil and a second voltage U2 at the second coil;

b) calculating a ratio (U1+K)/(U2+K) between the first voltage U1 plus a constant value K and the second voltage U2 plus the constant value K, wherein the constant value K is above the negative minimum of the second voltage U2 or below the negative maximum of the second voltage U2 and c) determining the magnetic zero position of the membrane by detecting a state, in which
the above ratio (U1+K)/(U2+K) equals 1 and
a gradient d(U1+K)/d(U2+K) of the above ratio is negative.

18. Method as claimed in claim 16, wherein in said state additionally the electromotive force $U_{emf1}$ of the first coil and/or the electromotive force $U_{emf2}$ of the second coil is positive.

19. Method as claimed in claim 17, wherein in said state additionally the electromotive force $U_{emf1}$ of the first coil and/or the electromotive force $U_{emf2}$ of the second coil is positive.

20. Method as claimed in claim 16, wherein in said state additionally the electromotive force $U_{emf1}$ of the first coil and/or the electromotive force $U_{emf2}$ of the second coil is negative.

21. Method as claimed in claim 17, wherein in said state additionally the electromotive force $U_{emf1}$ of the first coil and/or the electromotive force $U_{emf2}$ of the second coil is negative.

22. Method as claimed in claim 16, wherein a position of the membrane is calculated wherein the magnetic zero position obtained in step c) is used for initializing and/or resetting said calculation.

23. Method as claimed in claim 17, wherein a position of the membrane is calculated wherein the magnetic zero position obtained in step c) is used for initializing and/or resetting said calculation.

24. Method as claimed in claim 16, comprising the steps of:

d) calculating a velocity of the membrane based on an input voltage $U_{in}$ and an input current $I_{in}$ to a coil of the transducer and based on an idle driving force factor BL(0) of the transducer in an idle position of the membrane or in a magnetic zero position of the membrane obtained in step c);

e) calculating a position of the membrane by integrating said velocity;

f) calculating the velocity of the membrane based on the input voltage $U_{in}$ and the input current $I_{in}$ to the coil of the transducer and based on a driving force factor BL(x) of the transducer at the position of the membrane calculated in step e) and g) recursively repeating steps e) and f).

25. Method as claimed in claim 24, wherein the velocity, the input voltage $U_{in}$, the input current $I_{in}$, the idle driving force factor, the driving force factor and the position are related to the same point in time.

26. Method as claimed in claim 24, wherein the velocity, the input voltage $U_{in}$, the input current $I_{in}$, the idle driving force factor, the driving force factor and the position x are related to different points in time.

27. Method as claimed in claim 26, comprising the steps of:

d) calculating a velocity v(t) of the membrane based on an input voltage $U_{in}$(t) and an input current $I_{in}$ (t) to a coil of the transducer and based on an idle driving force factor BL(0)) of the transducer in an idle position of the membrane or in a magnetic zero position of the membrane obtained in step c);

e) calculating a position x(t) of the membrane by integrating said velocity v(t);

f) calculating the velocity v(t+1) of the membrane based on the input voltage $U_{in}$(t+1) and the input current $I_{in}$(t+1) to the coil of the transducer and based on a driving force factor BL(x(t) of the transducer at the position x(t) of the membrane calculated in step e) and g) recursively repeating steps e) and f) wherein t gets t+1.

28. Method as claimed in claim 24, wherein
the algorithm starts at step d) again when the magnetic zero position of the membrane is detected in step c) or
the velocity is stored in step d) and used for an arbitrary, later step e) when the magnetic zero position of the membrane is detected in step c).

29. Method as claimed in claim 24, wherein the position x(t) of the membrane is calculated by the formula
ti $x(t)=x(t-1)+v(t)\cdot\Delta t$.

30. Method as claimed in claim 24, wherein the velocity v(t) of the membrane is calculated by the formula $$v(t)=(U_{in}(t)-Z_c\cdot I_{in(}t))/BL(0) \text{ in step d) or by}$$

$$v(t+1)=(U_{in}(t+1)-Z_c\cdot I_{in}(t+1))/BL(x(t)) \text{ in step } f).$$

31. Method as claimed in claim 24, wherein the velocity v(t) of the membrane is calculated by the formula $$v(t+1)=v\sim(t+1)\cdot BL(0)/BL(x(t)) \text{ in step } f) \text{ wherein}$$

$$v\sim(t+1)=(U_{in}(t+1)-Z_c\cdot I_{in}\ (t+1))/BL(0).$$

32. Method as claimed in claim 24, wherein the velocity of the membrane is calculated by use of
the electromotive force $U_{emf1}$ of the first coil or
the electromotive force $U_{emf2}$ of the second coil or
the sum of the electromotive force $U_{emf1}$ of the first coil and the electromotive force $U_{emf2}$ of the second coil.

* * * * *